United States Patent [19]

Verini

[11] 4,150,381

[45] Apr. 17, 1979

[54] MOUNTING ASSEMBLY FOR AUTOMOBILE ANTENNA

[76] Inventor: Anthony J. Verini, 30 Lenox Ave., Green Brook, N.J. 08812

[21] Appl. No.: 793,742

[22] Filed: May 4, 1977

[51] Int. Cl.[2] ..... H01Q 1/32

[52] U.S. Cl. ..... 343/715; 248/223.4

[58] Field of Search ..... 343/713, 715; 248/223.4

[56] References Cited

U.S. PATENT DOCUMENTS

| | | | |
|---|---|---|---|
| 1,720,309 | 7/1929 | Wakefield | 248/223.4 |
| 2,952,343 | 9/1960 | Modrey | 248/223.4 |
| 3,071,338 | 1/1963 | Kaufman et al. | 343/713 |
| 4,028,705 | 6/1977 | Loyd | 343/715 |

*Primary Examiner*—Eli Lieberman

*Attorney, Agent, or Firm*—Frederick W. Padden

[57] ABSTRACT

An assembly for mounting an object such as a CB antenna and the like on rigid bodies, such as motor vehicles, trunk lids, and door frames, for example, comprises a support member mounted on the underside of the body and having a channel extending therethrough, a bracket for carrying the object and having a portion which is insertable into the channel, and resilient means for releasably securing the bracket in the channel.

8 Claims, 11 Drawing Figures

12
14
10
18
18.1
18.2
18.3
18.4
18.5
18.31
18.32
18.33
28
28.1
28.2
28.3
28.4
28.5
28.6
28.7
28.8
28.9
28.10
14.1
16
16.1
16.2
16.3
16.4

MOUNTING ASSEMBLY FOR AUTOMOBILE ANTENNA

BACKGROUND OF THE INVENTION

This invention relates to storable mount assemblies for communication band (CB) antennas, and the like, for use with radio transceiver equipment in motor vehicles.

The burgeoning popularity of CB equipment for motor vehicles has wrought a virtual plethora of CB antennas and assemblies for mounting the antennas at various locations—on trunk lids, door frames, rain gutters, and the like. Typical of prior art assemblies is the foldable antenna mount which is simply a step-like bracket hinged to the trunk rain channel. However, when folded down for storage, the antenna protrudes into the trunk space, thereby interfering with the storage space of the trunk. In addition, an antenna left in the stored position while the vehicle is in motion could be damaged if objects in the trunk accidentally bounce or slide against it. Another disadvantage of foldable-type mounts is that they are generally unsuitable for vehicles without trunk lids, for example, vans and buses.

Many of the problems associated with the foldable antenna mount are addressed by the dual pivot mount assembly described in my copending application, Ser. No. 737,552, filed on Nov. 1, 1976. This assembly comprises a rod-like support member pivotally mounted about a first axis to the underside of a trunk lid and a stepped bracket pivotally mounted to the support member about a second axis orthogonal to the first axis. Spring-loaded means couples the bracket to the support member for translation of the bracket along the second axis. The spring-loaded means includes a rod which has one end rigidly secured to a lower riser of the bracket, but is slideably and rotatably positioned through a hole in the rod-like support member. A spring, which coaxially surrounds the rod, is interposed between the other end of the rod and the support member. The bracket includes a flange on an upper riser which, in conjunction with the adjacent, lower tread, engages the trunk lid when the spring is compressed.

While the foregoing dual pivot mount assembly is a significant improvement over prior art mounts, it attains the advantages of versatility for use on a variety of different motor vehicles and storability without interference with interior vehicle space at the expense of somewhat increased complexity and hence increased manufacturing cost. In addition, the bracket with antenna attached, is not readily detached from the assembly, that is, from the rod-like support member.

Reference is also made to another of my copending applications, Ser. No. 762,442 filed on Jan. 26, 1977, now U.S. Pat. No. 4,114,160 which discloses subject matter related to CB antenna mounts.

It is, therefore, a broad object of my invention to provide a mount assembly for radio antennas.

It is another object of my invention to provide a mount assembly for CB radio antennas on motor vehicles.

It is still another object of my invention to provide such an assembly which is suitable for use in vehicles having trunk lids, as well as those which do not, and which permits the antenna to be stored without interfering with interior vehicle space.

It is another object of my invention to provide such an assembly in which the bracket is readily detached from the support member yet is secure from easy theft.

It is yet another object of my invention to provide such an assembly which is simple to construct and inexpensive to manufacture.

SUMMARY OF THE INVENTION

These and other objects are accomplished in accordance with my invention, an assembly for mounting an object on a rigid body comprising a support member mounted on said body and having a channel extending therethrough, a bracket for carrying the object and having a portion which is insertable into the channel, and resilient means for releasably securing the bracket in the channel.

In one illustrative embodiment of my invention, the assembly comprises a rectangular support member mounted on the rigid body and having a pair of facing flanges which form a channel, a step-like bracket having a first tread for carrying the object, and a second tread which is insertable into the channel. The resilient means, which secures the bracket to the support member, includes a pair of elongated, planar fingers which extend from the second tread and are laterally and inwardly compressed when inserted into the channel. The fingers are shaped so that, after insertion, they engage the support member to prevent retraction of the bracket until the fingers are again compressed.

In another illustrative embodiment of my invention, the assembly comprises a rectangular support member, mounted on the rigid body, which includes a pair of facing plates, forming a channel therebetween, a step-like bracket having a tread for carrying the object and a second tread which is insertable into the channel. The resilient means, which releasably secures the bracket to the support member, includes on at least one plate an extended, curved member which protrudes into the channel so that the second tread deflects the member outwardly, thus holding that tread under a compressive force.

In a third embodiment, analogous to the second, one of the plates includes a raised plateau-like central portion forming the channel and a second riser of the bracket is folded upon itself so that when the end of that riser is inserted into the channel the folded riser springs open slightly to fit snuggly around the plateau. In this case, the resilient means includes the folded riser adapted to the shape of the plateau.

In a specific exemplary embodiment of my invention, the above assemblies are adapted for storeably mounting CB radio antennas on automobiles. In the first two embodiments, a pair of channeled support members are generally mounted on the underside of a trunk lid, for example. One support member is placed along the edge of the lid with the channel axis essentially perpendicular to the edge. This support member is used for mounting an antenna above the trunk lid, the position for normal CB operation. The other support member is placed inward from the edge of the trunk lid with the channel oriented essentially parallel to the edge. This support member is used for storing the antenna in the trunk when not in use.

The third embodiment, on the other hand, is particularly suitable for mounting on vehicle door frames, especially small door frames, such as found on many small, foreign cars. In this case, the support member is mounted on the underside of the door frame; the folded riser engages the plateau of the support member; and the vehicle door, when closed, abuts against that riser.

BRIEF DESCRIPTION OF THE DRAWINGS

My invention, together with its various features and advantages, can be readily understood from the following more detailed description taken in conjunction with the accompanying drawings, in which.

DETAILED DESCRIPTION

FIGS. 1-5

Figures 1, 2A, 2B:
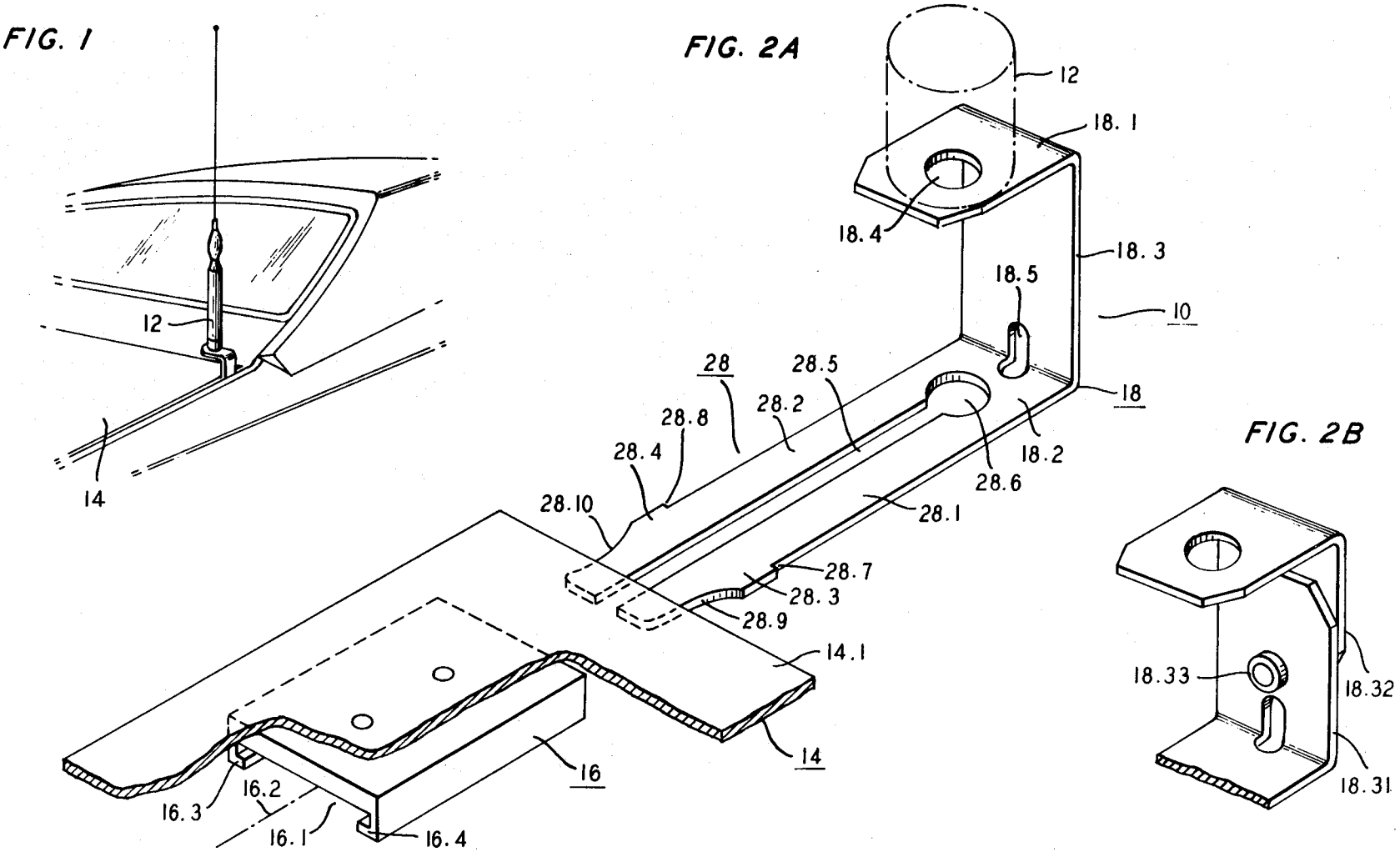
FIG. 1 depicts a CB antenna mounted on an assembly which, in turn, is mounted on the underside of an automobile trunk lid.
FIG. 2A is a pictorial view of a mount assembly in accordance with one embodiment of my invention in which resilient planar fingers engage the channel of a support member; this view depicts the antenna mounted above a trunk lid for normal operation.
FIG. 2B is a pictorial view showing a modified version of the bracket of FIG. 2A in which the upper riser is made of rotatable and disengageable parts so that the antenna can be rotated about the remainder of the bracket.

With reference now to FIG. 2A, there is shown an assembly 10 for mounting an object 12 above and slightly to the side of a rigid boy 14. Typically, body 14 is a wall or lid portion of a storage compartment. Assembly 10 comprises a support member 16 mounted on body 14 and having a channel 16.1 extending therethrough, a bracket 18 which carries object 12 and which is insertable into channel 16.1, and resilient means 28 for releasably securing bracket 18 to support member 16.

Figure 5:
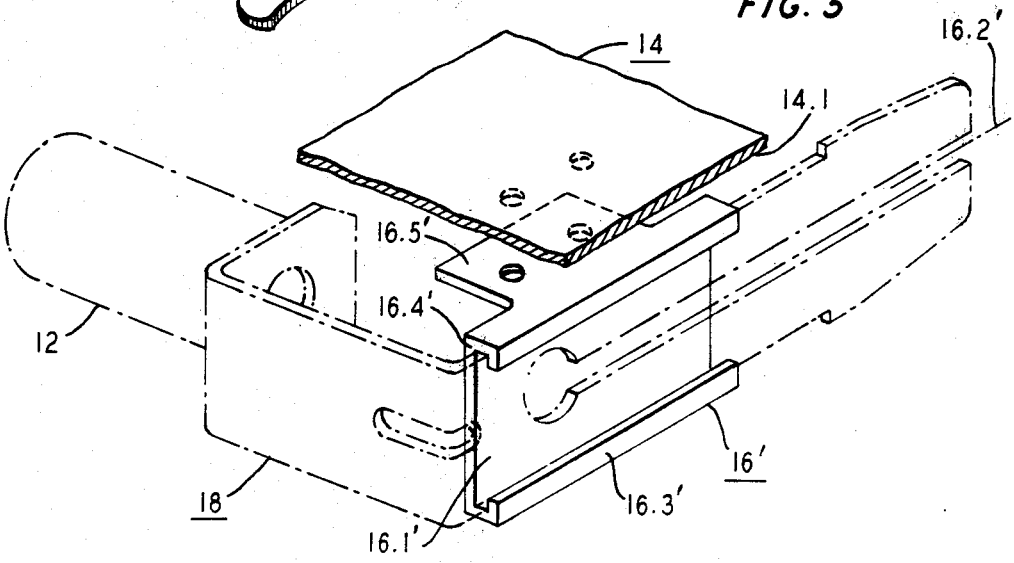
FIG. 5 is a pictorial view similar to FIG. 2A except that the antenna is depicted in its stored position.

The configuration depicted in FIG. 2A shows bracket 18 oriented for normal use or operation of object 12 which might be an antenna or search light, for example. In this position, it should be noted that the plane of channel 16.1 extends essentially parallel to the underside of body 14 and axis 16.2 of channel 16.1 extends in a direction substantially perpendicular to edge 14.1 of body 14. In contrast, when object 12 is to be stored, as shown in FIG. 5, a separate support member 16' is utilized in which the plane of channel 16.1' extends essentially perpendicular to the underside of body 14, and axis 16.2' of channel 16.1' extends in a direction substantially parallel to edge 14.1 of body 14. The terms "essentially" perpendicular and "substantially" parallel are used above to connote that precise zero or ninety degree angles are not required and, indeed, in the storage position shown in FIG. 5, angles grossly different from zero or ninety degrees are suitable although not preferable. Basically, simple engineering discipline should be exercised to insure that the support member is oriented so that movement of body 14 (e.g., an automobile trunk lid) is not inhibited and interference with compartment space (e.g., the trunk) is minimized.

Figure 3:
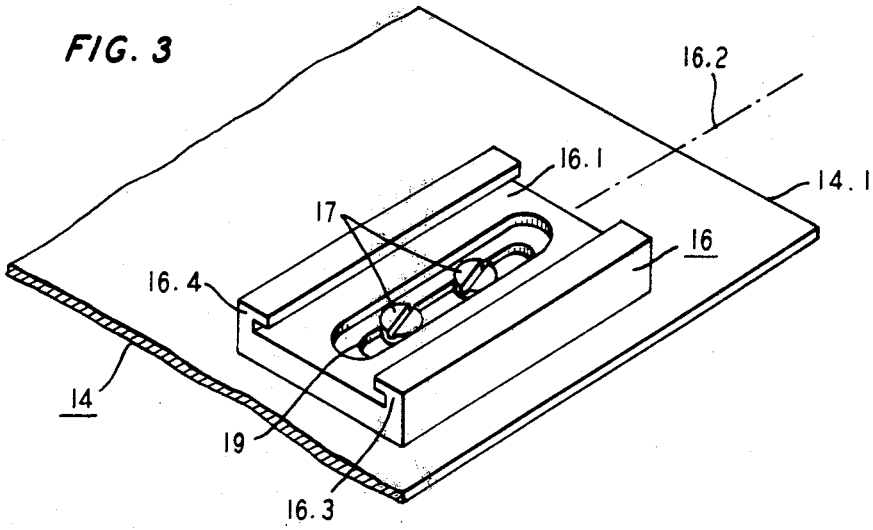
FIG. 3 is a pictorial view of the underside of the support member of FIG. 2A.

In an illustrative embodiment of my invention, an assembly is designed to mount a CB antenna 12 above the trunk lid of an automobile as shown in FIG. 1. The assembly, shown in FIGS. 2A, 3 and 5, comprises a support member 16 mounted on the underside of trunk lid 14 by means of suitable fasteners (screws 17 in slot 19 of FIG. 3 or screws, not shown, in appendage 16.5' of FIG. 5). Member 16 has a channel 16.1 formed by elongated, parallel flanges 16.3 and 16.4. The plane of channel 16.1 extends essentially parallel to the underside of lid 14, and the axis 16.2 of channel 16.1 extends substantially perpendicular to the edge 14.1 of lid 14 along which antenna 12 is to be mounted.

The assembly also includes a stepped bracket 18 having upper and lower treads 18.1 and 18.2, respectively, joined together by riser 18.3. Although both treads are depicted here as extending in the same direction from riser 18.3, upper tread 18.1 can be oriented in the opposite direction if so desired. In either case, antenna 12 is mounted on upper tread 18.1 by screwing or otherwise securing it in hole 18.4. Oblong aperture 18.5 is located across the joint between riser 18.3 and lower tread 18.2 and functions to allow the antenna cable (not shown) to be inserted therethrough.

An important aspect of this embodiment is the configuration of resilient means 28 for releasably securing bracket 18 to support member 16. Means 28 includes a pair of elongated, planar, parallel, rectangular fingers 28.1 and 28.2 which append from lower tread 22 and which are separated from one another along their length by a rectangular space or channel 28.5. The latter extends from hole 28.6 which has a diameter larger than the width of channel 28.5. The elongated, separated nature of fingers 28.1 and 28.2 allows them to be deflected inwardly toward one another, a feature to be discussed hereinafter. In addition, the ends of the fingers remote from riser 18.3 terminate in segments 28.3 and 28.4 which flare outwardly at rectangular portions to form notches 28.7 and 28.8, respectively, and then taper inwardly along edges 28.9 and 28.10, respectively.

In operation, assume that priorly support members 16 and 16' have been mounted on the underside of a trunk lid and that antenna 12 has been mounted on upper tread 18.1 of bracket 18. Then, in order to position the antenna for normal transceiver usage, resilient means 28 is inserted into one end of support member 16 so that inwardly tapered edges 28.9–28.10 abut the inner walls of flanges 16.3–16.4 and urge or deflect fingers 28.1–28.2 toward one another. Means 28 is pushed into channel 16.1 until notches 28.7–28.8 emerge beyond the opposite end of support member 16. At this point, the fingers snap outwardly from one another and lock bracket 18 into member 16. It is apparent, therefore, that the length of fingers 28.1–28.2 plus lower tread 18.2 (i.e., the distance from notches 28.7–28.8 to riser 18.3) should be greater than the length of channel 16.1.

In order to demount the bracket 18 from trunk lid 14, fingers 28.1–28.2 are squeezed together until segments 28.3–28.4 at notches 28.7–28.8 clear the inside walls of flanges 16.3–16.4. Then bracket 18 can be pulled out of channel 16.1. Storage of bracket 18 and attached antenna 12 is effected in the same manner as mounting except that orthogonal support member 16' shown in FIG. 5 is utilized. Insertion and removal procedures are identical to those described with reference to FIG. 2A.

The riser 18.3 of FIG. 2A can be made, as shown in FIG. 2B, in separable segments 18.31 and 18.32 joined together by a suitable fastener 18.33, such as a bolt and nut. Such an arrangement allows the antenna and upper portion of the bracket to be detached from the lower portion thereof without removing the bracket 18 from the support member 16. A significant advantage of the structure of FIG. 2B is that it allows the antenna to be oriented vertically for correct polarization and maximum signal reception merely by loosen fastener 18.33, rotating the segment 18.32, and then tightening fastener 18.33.

Figure 4:
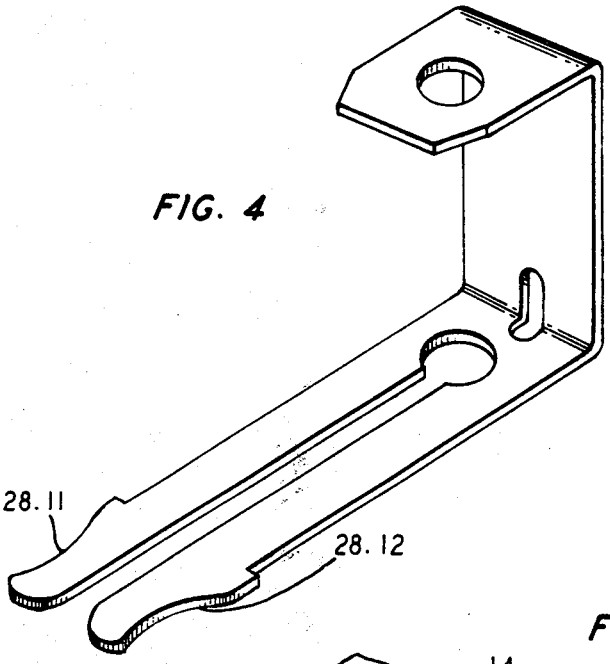
FIG. 4 is a pictorial view of another embodiment of my invention, analogous to FIG. 2A but in which the resilient planar fingers end in S-shaped segments.

Moreover, the segments 28.3–28.4 at the ends of fingers 28.1–28.2 can take on shapes other than that defined by the inwardly tapered edges 28.9–28.10 of FIG. 2A. Thus, for example, the segments can have S-shaped edges 28.11–28.12, as shown in FIG. 4.

FIGS. 6–7

Figure 6A:
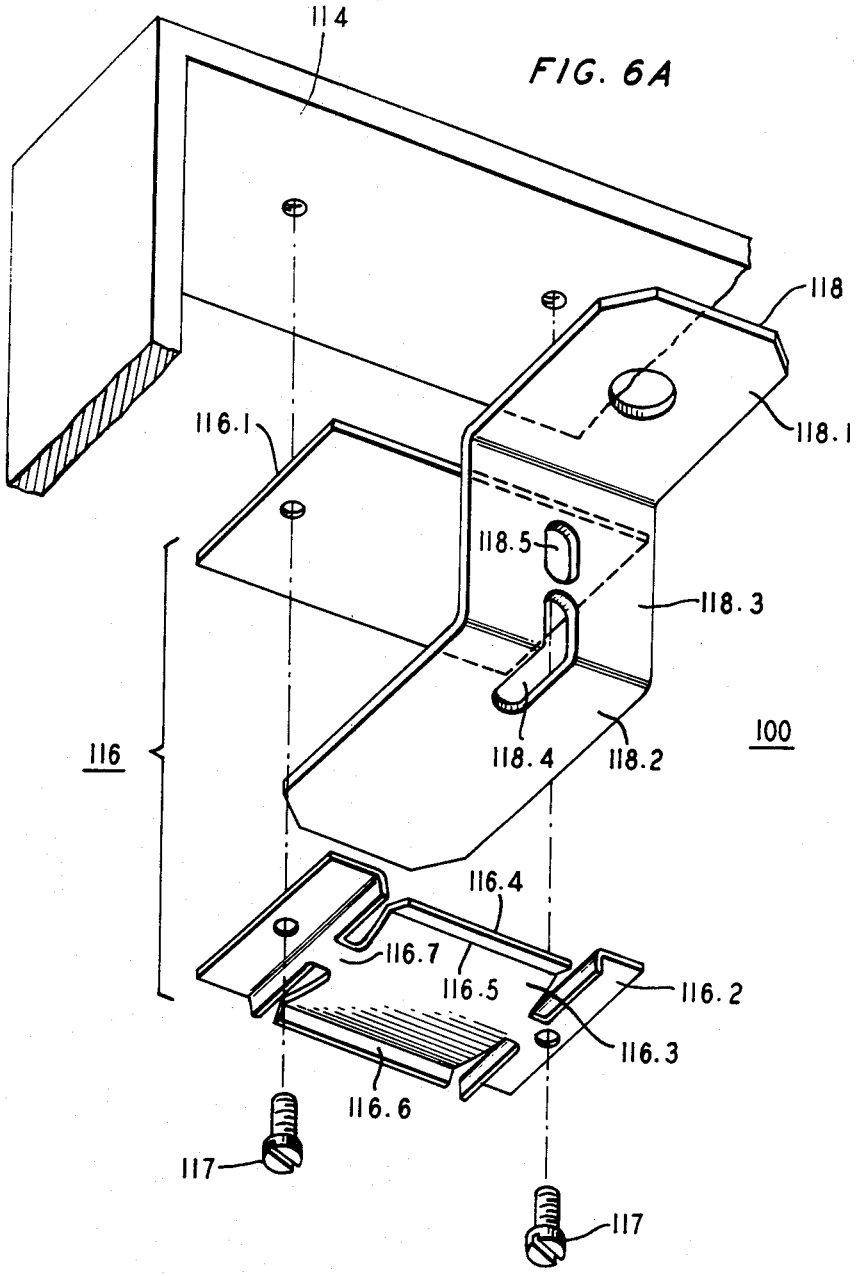
FIG. 6A is a pictorial view of a mount assembly in accordance with another embodiment of my invention in which the support member includes a pair of facing plates forming a channel therebetween and at the outer plate has extended curved members which protrude into the channel.
Figure 6B:
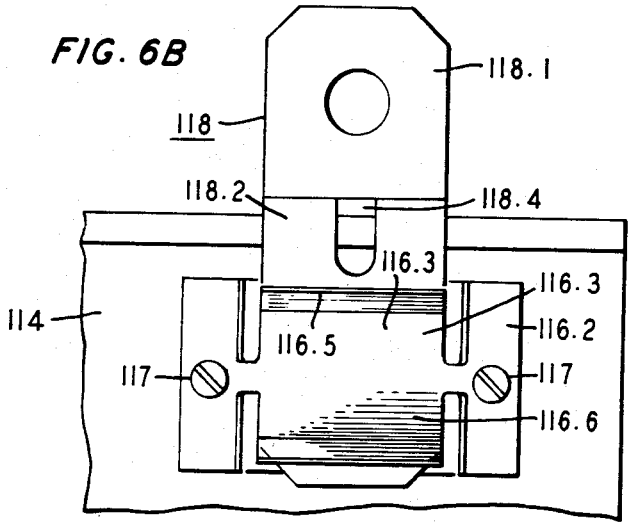
FIG. 6B shows a plan view of FIG. 6A with the bracket inserted in the channel of the support member.

In an alternative embodiment of my invention, as shown in FIGS. 6A–6B, assembly 100 comprises a support member 116 mounted via screws 117 onto the underside of a rigid body, such as an auto inner door frame or trunk lid 114. The support member 116 includes a pair of facing plates 116.1 and 116.2 forming a channel therebetween. In particular, at least one of the plates, such as outer plate 116.2, includes a raised central rib 116.7 and appended thereto an extended, curved member 116.3 which protrudes into the channel. Preferably, the free edge 116.4 of member 116.3 is bent upwardly along edge 116.5 to facilitate insertion of bracket 118 to be hereinafter described. As shown in FIG. 6A, two such curved members 116.3 and 116.6 are appended on opposite sides of rib 116.7 to provide additional force on the bracket. That is, stepped bracket 118 includes upper and lower treads 118.1 and 118.2, respectively, joined to one another by riser 118.3. As before, upper tread 118.1 carries the antenna (not shown) and lower tread 118.2 is insertable into the channel between plates 116.1 and 116.2

The height of the channel, which is determined by the position of edge 116.5, is made to be smaller than the thickness of lower tread 118.2. Consequently, when the lower tread is inserted in the channel, as in FIG. 6B, curved member 116.3 (and then curved member 116.6 also) is deflected upwardly so that a downward force on tread 118.2 secures bracket 118 in the channel.

From another standpoint, however, assembly 100 can be viewed as including resilient means for releasably securing bracket 118 in support member 116 in which the means comprises extended, curved members 116.3 and 116.6.

It should be noted that planar plate 116.1 is optional and is used primarily when the underside of trunk lid 114 is not flat or is otherwise unsuitable for mounting plate 116.2 or for providing a relatively smooth surface for sliding bracket 118 into the channel.

As with the embodiment of FIG. 2A, oblong apertures 118.4 and 118.5 allow the antenna cable (not shown) to be "snaked" therethrough so that it does not hang loosely.

FIG. 7

Figure 7B:
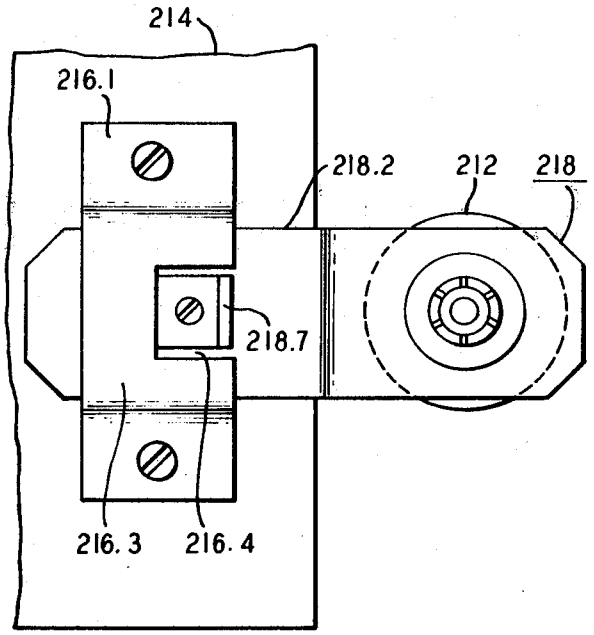
FIG. 7B is a plan view of FIG. 7A with the bracket inserted into the channel of the support member.
Figure 7A:
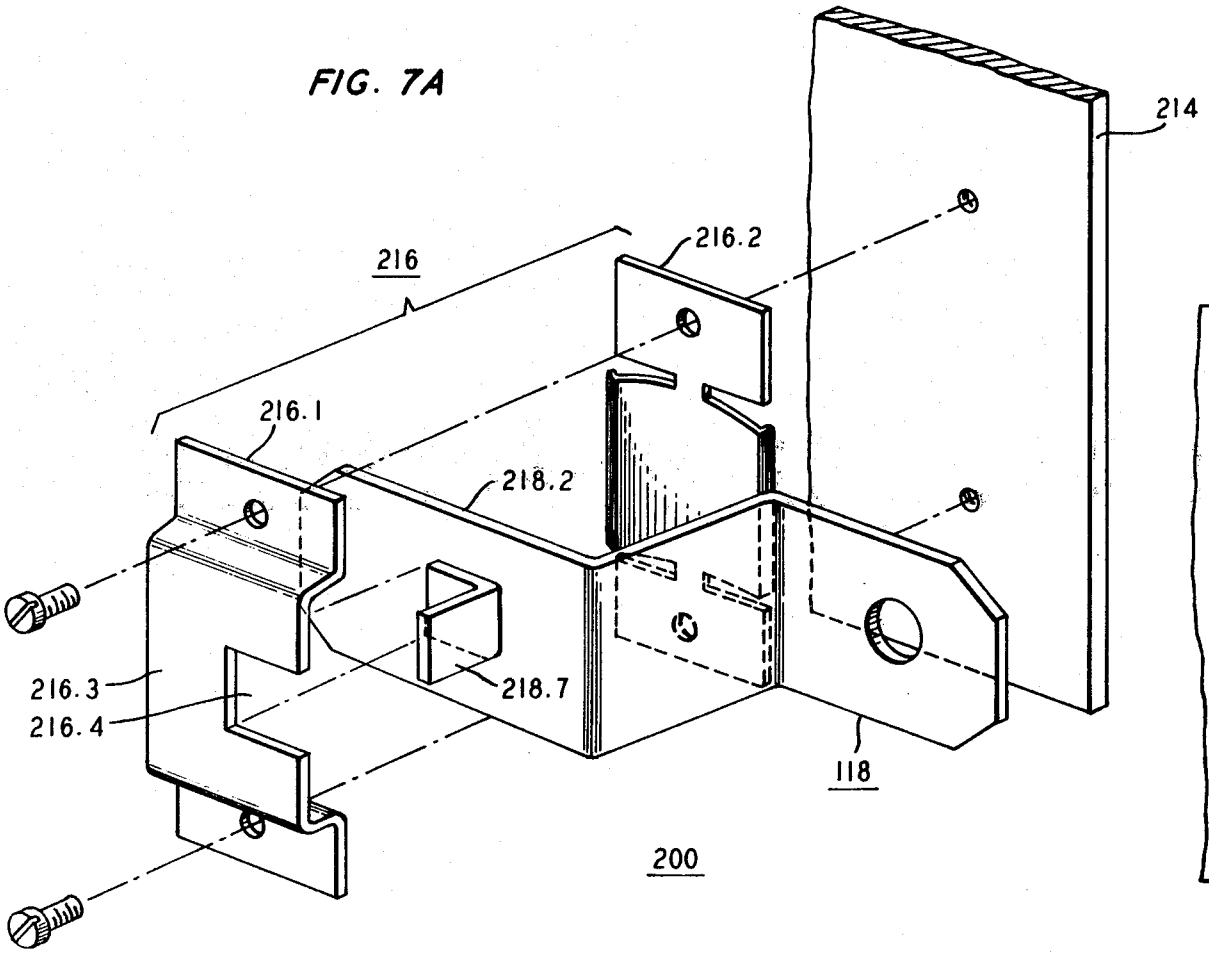
FIG. 7A is a pictorial view similar to FIG. 6A except that the inner plate has the extended curved members; whereas, the outer plate has a notch to receive an L-shaped bar on the bracket.

Another embodiment of my invention, shown in FIGS. 7A–7B, is a modification of FIGS. 6A–6B adapted to prevent theft of the antenna and bracket 118 when the assembly is mounted on an automobile inner door frame. More specifically, assembly 200 comprises a support member 216 mounted on the underside of a door frame 214 and having a channel extending therethrough for receiving lower tread 218.2 of bracket 218.

Support member 216 includes a pair of facing plates 216.1 and 216.2 which define the channel and provide resilient means for releasably securing bracket 218 in the channel. That is, inner plate 216.2 is of the same type as outer plate 116.1 of FIG. 6A, and, hence, in the interests of brevity, will not be described further. Outer plate 216.1, on the other hand, has a central plateau portion 216.3 and a rectangular slot 216.4 therein. Lower tread 218.2 of bracket 218 has an appendage 218.7, illustratively shown as an L-shaped member, which slides into slot 216.4 when bracket 218 is inserted into the channel. At the same time, the curved members of inner plate 216.2 are deflected so that lower tread 218.2 is urged against plateau 216.3. After bracket 218 is inserted into the channel of support member 216, as shown in FIG. 7B, the auto door, when closed, abuts appendage 218.7 and prevents the bracket 218 (and hence the antenna 212) from being removed from the assembly.

In this embodiment, resilient means for releasably securing bracket 218 in the channel includes the extended curved members of inner plate 216.2 which cooperate with plateau 216.3 to apply securing forces to lower tread 218.2.

FIG. 8

Figure 8:
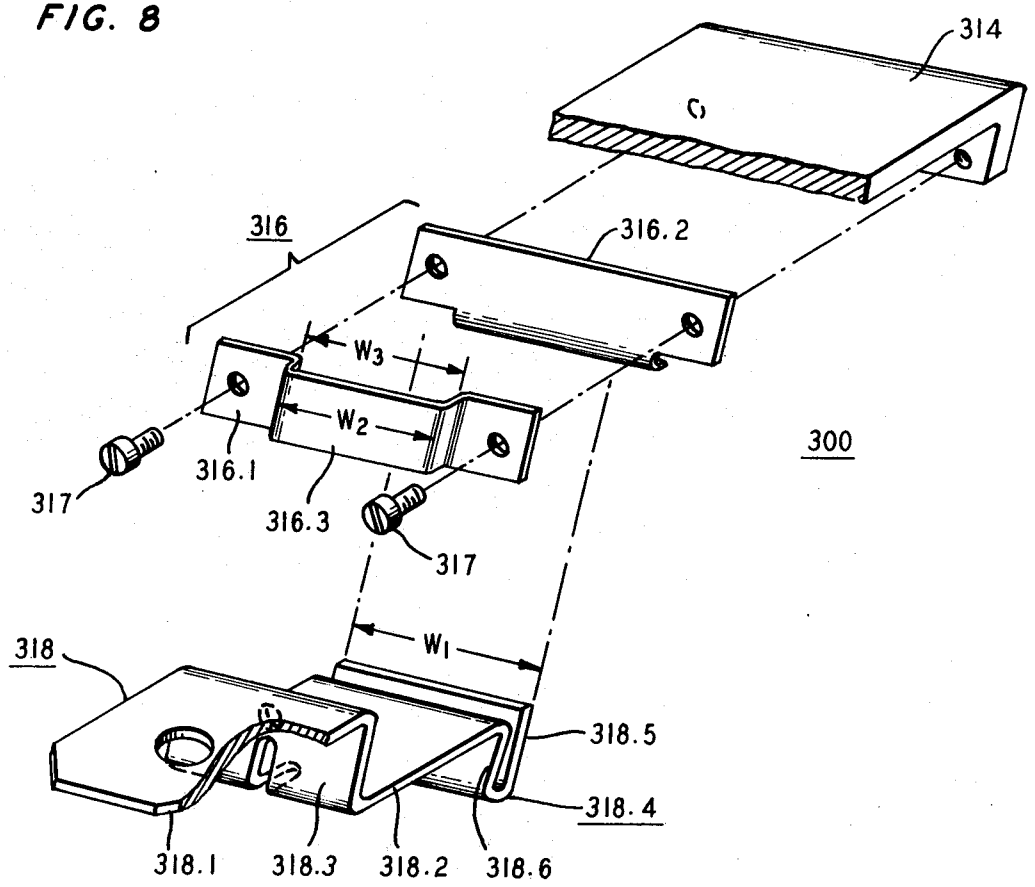
FIG. 8 is a pictorial view of yet another embodiment of my invention in which the resilient means arises from a folded lower riser on the bracket being adapted to a plateau shaped plate of the support member.

Another embodiment of my assembly, as shown in FIG. 8, is particularly adapted for mounting on vehicles with small inner door frames. In particular, the assembly 300 comprises a support member 316 mounted on the underside of a door frame 314 by means of screws 317 or other suitable fasteners. The member 316 includes a pair of facing plates 316.1 and 316.2 with the inner, optional plate 316.2 abutting the door frame and with the outer plate 316.1 having a central plateau 316.3 and covering the inner plate to form a spring-action channel therebetween. The assembly 300 also includes a stepped bracket 318 having upper and lower treads 318.1 and 318.2, respectively, joined together via upper riser 318.3. Unlike the brackets of other embodiments, however, bracket 318 also includes a lower riser 318.4 appended to lower tread 318.2. It is a feature of this embodiment that the resilient means for releasably securing the bracket 318 in the channel includes a mutual adaptation of the plateau 316.3 and plates 316.1 and 316.2 and the lower riser 318.4. More specifically, the lower riser is folded upon itself so as to form connected upwardly and downwardly directed segments 318.5 and 318.6, respectively. These segments are slightly closer together at the free end of segment 318.5 than at the joint between the segments. In addition, the width $W_1$ of segment 318.5 is made to be slightly larger than the narrowest width of the plateau (i.e., the dimension $W_2$ along the upper surface of the plateau) but, of course, smaller than the channel width $W_3$ to permit insertion.

In operation, a CB antenna is mounted in usual fashion on upper riser 318.1 and support member 316 is bolted to door frame 314. Lower riser 318.4 (i.e., upwardly directed segment 318.5) is pushed into the channel between facing plates 316.1 and 316.2. Because of the above-described manner in which the lower tread 318.4 is configured in relation to the plateau 316.3, the bracket essentially snaps into place; i.e., the plateau deflects the segments 318.5–318.6 apart slightly so that a compressive force holds the bracket 318 in the support member 316.

While the foregoing description contains many specifications, these should not be construed as limitations upon the scope of the invention, but merely as an indication of several preferred embodiments thereof; the true scope of the invention is indicated by the subject of the appended claims and their legal equivalents.

What is claimed is:

1. An assembly for mounting an antenna to a trunk lid, door frame, or other rigid part of a motor vehicle comprising:

a support member mounted on said rigid part including a first plate having a raised portion forming a channel thereunder, a stepped bracket including an upper tread for carrying said antenna, a lower tread which is insertable into said channel and a riser joining together said treads, and resilient means for releasably securing said bracket to said support member comprising a pair of extended, curved members which append in opposite directions from said raised portion and which downwardly protrude into said channel so as to be deflected upwardly when said lower tread is inserted into said channel, a free edge portion of said curved members being bent upwardly to facilitate insertion of said lower tread.

2. The assembly of claim 1 including a second plate which is substantially flat and which abuts and rigid part, and wherein said first plate covers said second plate and forms said channel therebetween.

3. The assembly of claim 1 wherein said first plate abuts said rigid part and including a second plate which covers said first plate and which has a central plateau forming said channel between said plateau and said raised portion, said plateau having a rectangular notch therein, and an L-shaped appendage extending from said lower tread of said bracket, said notch being adapted to receive said appendage when said lower tread is inserted into said channel.

4. An assembly for mounting an antenna on a rigid body of an automobile comprising:

a support member mounted on said body and having a channel extending therethrough, a bracket for carrying said antenna and having a portion which is insertable into said channel, and resilient means for releasably securing said bracket to said support member when said bracket portion is inserted into said channel, said support member including a plate having a raised portion forming said channel thereunder, and said resilient means includes an extended, pair of curved members appended to said raised portion of said plate so as to protrude downwardly into said channel and so as to be deflected upwardly when said bracket portion is inserted into said channel, thereby releasably securing said bracket to said support member.

5. The assembly of claim 4 wherein a free edge portion of each of said curved members is bent upwardly to facilitate insertion of said bracket portion into said channel.

6. The assembly of claim 4 wherein said bracket has a stepped configuration and includes an upper tread for carrying said object, a lower tread defining said bracket portion, and a riser joining together said treads.

7. The assembly of claim 6 including a second plate which abuts said body and is substantially flat, and said first plate covers said second plate and forms said channel therebetween.

8. The assembly of claim 6 wherein said first plate abuts said body and including a second plate which covers said first plate and has a central plateau forming said channel between said plates, said plateau having a notch therein, and an appendage extending from said lower tread of said bracket, said notch being adapted to receive said appendage when said lower tread is inserted into said channel.

* * * * *